United States Patent [19]

Holsomback

[11] 4,149,382

[45] Apr. 17, 1979

[54] HYDRAULIC ELEVATOR POWER ASSEMBLY

[75] Inventor: Jesse J. Holsomback, Pearland, Tex.

[73] Assignee: Houston Elevator Service, Inc., Houston, Tex.

[21] Appl. No.: 838,149

[22] Filed: Sep. 30, 1977

[51] Int. Cl.[2] ..... F15B 1/06; F15B 15/18

[52] U.S. Cl. ..... 60/477; 60/DIG. 2; 60/DIG. 10; 60/469; 187/28

[58] Field of Search ..... 60/458, 477, 494, DIG. 2, 60/DIG. 10, 469; 187/8.43, 9 E, 28; 254/93 R; 137/565; 417/313

[56] References Cited

U.S. PATENT DOCUMENTS

| | | | |
|---|---|---|---|
| 1,165,653 | 12/1915 | Dunn | 60/494 |
| 3,530,958 | 9/1970 | Brannon et al. | 60/329 X |
| 3,708,977 | 1/1973 | Raymond | 60/469 |
| 3,723,027 | 3/1973 | Montelius | 417/313 |
| 3,993,094 | 11/1976 | Spooner | 60/DIG. 10 |

*Primary Examiner*—Edgar W. Geoghegan
*Attorney, Agent, or Firm*—Bill B. Berryhill

[57] ABSTRACT

A power assembly for supplying power to a hydraulic piston and cylinder unit for raising and lowering an elevator car. The power assembly may comprise: a hydraulic fluid reservoir; a hydraulic pump assembly, the intake of which is connected to the reservoir and the outlet of which is connected to the piston and cylinder unit; and a control valve disposed above the hydraulic reservoir for controlling the flow of fluid to and from the piston and cylinder unit.

6 Claims, 4 Drawing Figures

HYDRAULIC ELEVATOR POWER ASSEMBLY

BACKGROUND OF THE INVENTION

1. Field of the Invention

The present invention pertains to power assemblies for raising and lowering elevators. Specifically, it pertains to a hydraulic power assembly for supplying hydraulic power to the piston and cylinder unit of a hydraulic elevator.

2. Description of the Prior Art

In a hydraulic elevator, a vertical hole is normally drilled at the bottom of the elevator shaft and a hydraulic piston and cylinder unit placed therein. A rod acting as a piston is disposed in the cylinder and attached at the upper end thereof to the base of the elevator car. When fluid power is supplied to the piston and cylinder unit, the piston rod is raised, causing the elevator to rise. To lower the elevator, fluid is simply removed from the piston and cylinder unit, allowing the piston rod to descend as the elevator car descends.

As a rule, the power assembly for supplying pressurized fluid to the piston and cylinder unit, is mounted at some accessible location and connected to the piston and cylinder unit by a hydraulic line. The power assembly conventionally includes a fluid reservoir, a hydraulic pump, and a hydraulic valve for controlling fluid flow to and from the piston and cylinder unit. In addition, control apparatus is provided for controlling the operation of the pump and control valve. These items are conventionally mounted in a unitary housing so that the power assembly can be preassembled before installation to provide a compact and easily installed unit.

Unless the fluid reservoir of a power assembly is mounted above the pump, the pump will not have a positive suction head. Therefore, in power assemblies of recent years, the pump is mounted below the fluid reservoir. As a natural consequence, the control valve is also normally mounted with the pump below the fluid reservoir. However, the control valve of a power assembly is one of the most frequently maintained components of the assembly and requires occasional removal for replacement of seals or other repairs. In power assemblies of the prior art where the valve is mounted below the fluid reservoir, removal or dismantling of the control valve frequently results in the loss of fluid and spillage on the floor. Such spillage creates unsightly as well as potentially dangerous conditions.

Power assemblies for hydraulic elevators are usually placed in restricted space areas. This also creates problems with power assemblies of the prior art. It is difficult for a repairman to work on the pump or control valve of a power assembly which is mounted in a confined space below the fluid reservoir. Not only is the space restricted, the repairman must work in a sitting or squatting position. Furthermore, the pump is frequently driven by an electric motor connected to the pump by a belt. In power assemblies of the prior art, the belt is mounted near the access to the unit where the repairman is most likely to get his hand, foot or clothing caught therein.

SUMMARY OF THE INVENTION

The power assembly of the present invention, like those of the prior art, includes a fluid reservoir, a hydraulic pump and a control valve. The pump is mounted below the fluid reservoir so as to take advantage of the positive suction head provided thereby. However, unlike power assemblies of the prior art, the control valve is mounted above the fluid reservoir so that when it is disconnected for replacement or repair, fluid from the valve and associated conduits drain directly into the fluid reservoir eliminating loss of fluid and unsightly and dangerous spillage on the floor.

The location of the control valve above the fluid reservoir also makes it easier to work on since the repairman would normally be in an upright or standing position to do so. The valve location also reduces the working area required and results in a saving of floor area. This is particularly important in a building where every square foot of area lost to auxiliary equipment is potentially lost revenue from tenants.

The location of the control valve above the fluid reservoir also provides for safer repair. In addition, greater safety is obtained by mounting the drive coupling between the pump and its prime mover on the side of the unit opposite its work access. This prevents a repairman from getting his hand or foot caught in the coupling while working on the assembly.

Many other objects and advantages of the invention will be apparent from reading the description which follows in conjunction with the accompanying drawings.

DESCRIPTION OF A PREFERRED EMBODIMENT

Figure 1:
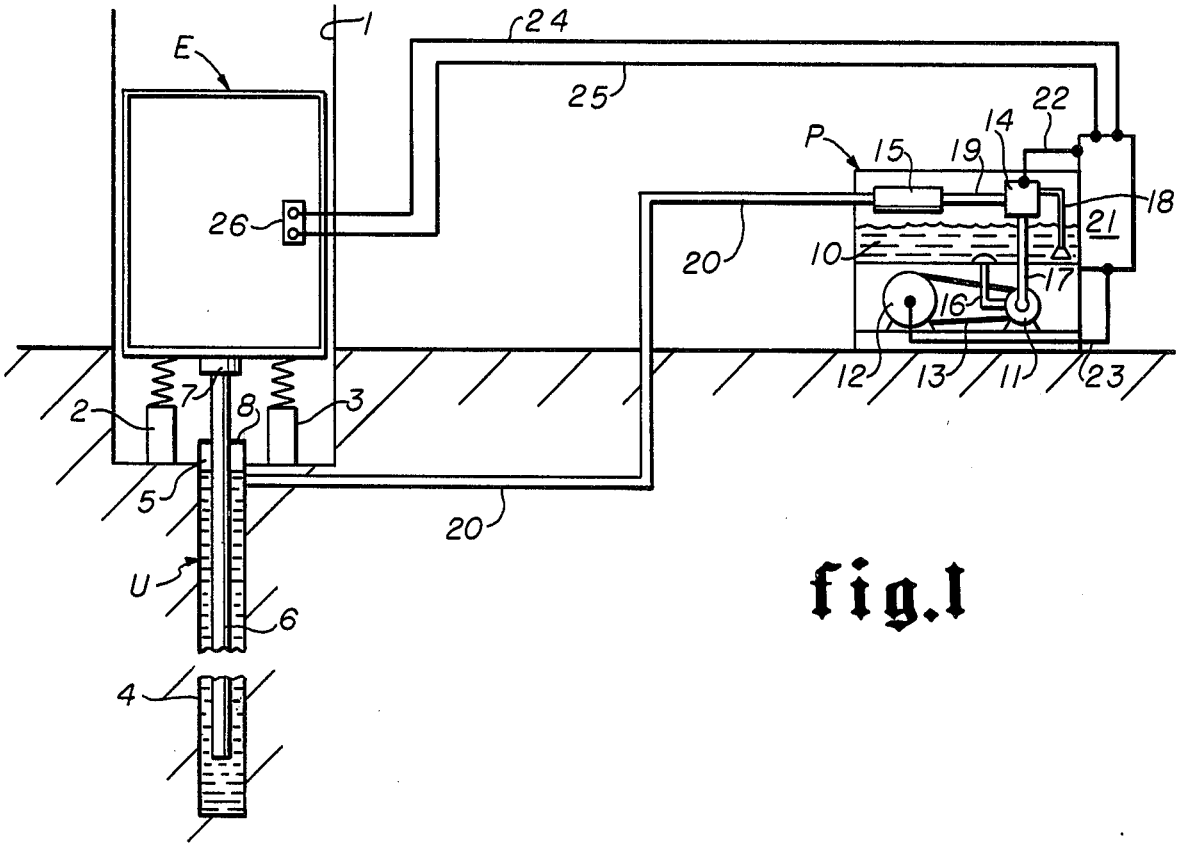
FIG. 1 is a schematic representation of a hydraulic elevator utilizing a power assembly, according to a preferred embodiment of the invention.

Referring first to FIG. 1, there is schematically represented a power assembly P for supplying the hydraulic power necessary for raising and lowering of an elevator car E. The elevator car E is mounted in a vertical elevator shaft 1 at the bottom of which is mounted shock assemblies or springs 2 and 3. Placed in a vertical hole drilled therefor at the bottom of the elevator shaft 1 is a piston and cylinder unit U. The piston and cylinder unit may comprise a cylinder 4 having a head 5, and a piston rod 6 reciprocal within cylinder 4. At its upper end, the piston rod 6 bears against a bearing plate 7 which is attached to the elevator car E. Appropriate seals 8 are provided in the cylinder head 5 for sealing against the piston rod 6.

The power assembly P comprises a fluid reservoir 10, a pump 11 connected to an electric motor 12 by some coupling means such as a belt 13. Also provided is a control valve 14 and if desired, a noise suppressor 15. The suction side of the pump 11 is in fluid communication with the reservoir 10 through conduit 16. The discharge side of the pump 11 is connected to control valve 14 by conduit 17. Conduit 18 provides fluid communication between the control valve 14 and fluid reservoir 10. Conduits 19 and 20 provide, via noise suppressor 15, fluid communication between the control valve 14 and the piston and cylinder unit U.

Electrical control components are mounted within a control panel 21 and connected by suitable electrical conduits 22 and 23 to control valve 14 and motor 12 for controlling operation of the pump 11 and control valve 14, as will be more fully understood hereafter. The control panel 21 is also connected, via suitable electrical conduits 24 and 25, to the operating controls 26 located in the elevator car E.

Upon the appropriate signal from the operator panel 26 to control panel 21, the pump 11 is actuated, taking fluid from reservoir 10 and pumping it under pressure to control valve 14 and conduits 19 and 20 to the piston and cylinder unit U. As fluid is supplied under pressure to the cylinder 4, the piston rod 6 is raised, consequently raising the elevator car E until the appropriate signal is supplied for indicating on what level the elevator car E is to be stopped. Until another signal is supplied, the control valve 14 will be closed preventing fluid from returning from piston and cylinder unit U to the reservoir 10 and leaving the elevator car E at its raised level. Upon a subsequent signal from the operator panel 26, the control valve 14 is opened to discharge through conduit 18 allowing fluid to return from the cylinder 4 through conduits 20, 19 and 18, into the fluid reservoir 10. This then in summary describes the general operation of a hydraulic elevator with the power assembly of the present invention.

Figure 4:
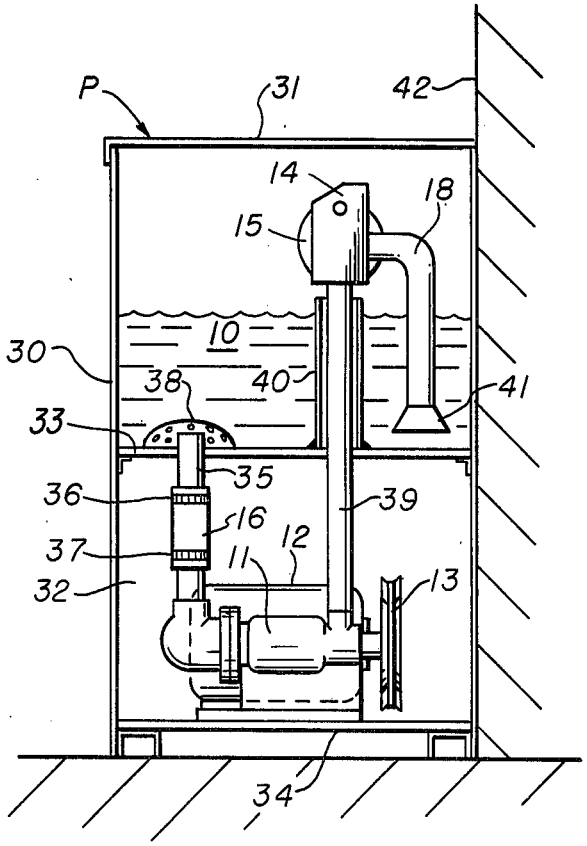
FIG. 4 is a vertical cross-sectional view of the power assembly of the present invention.
Figure 2:
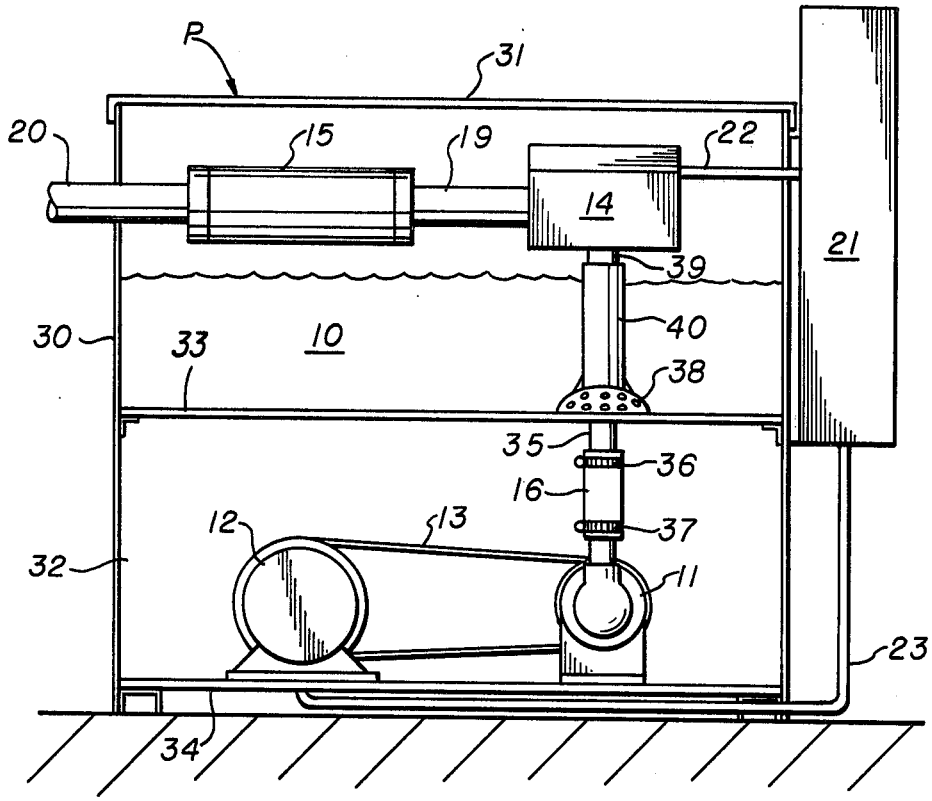
FIG. 2 is a side elevation view, partially in section, of a power assembly according to a preferred embodiment of the invention.
Figure 3:
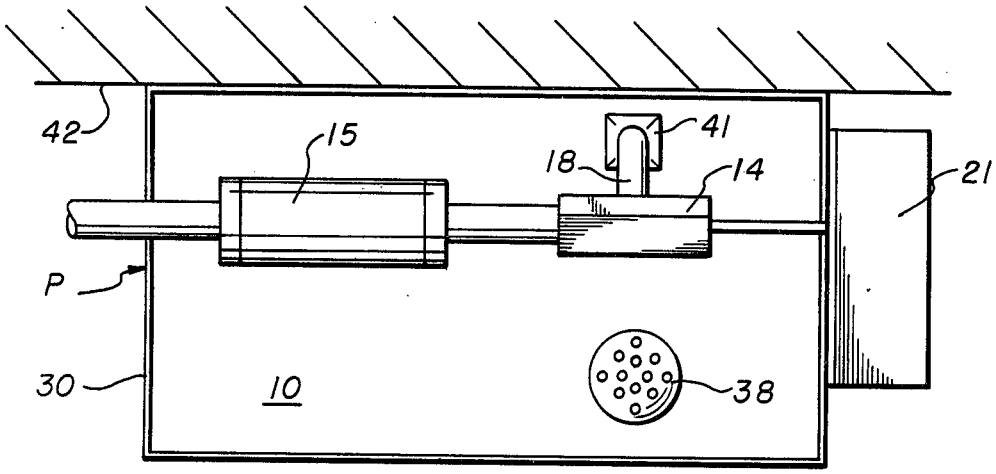
FIG. 3 is a top plan view of the power assembly of the present invention with the reservoir cover thereof removed.

Referring now to FIGS. 2–4, more specific details of the power assembly P will be shown and described. The power assembly P is preferably preassembled as a unit and housed in a housing 30 which may be provided with a top cover 31 and a side working access or place of egress 32. Upper and lower portions of the housing 30 are separated by a horizontal partition 33 which forms the bottom of fluid reservoir 10. On one end of the housing 30 may be mounted the control panel 21 for containing the electrical or other type controls necessary for proper control of the power assembly P.

Mounted in the lower portion of the housing 30 is the hydraulic pump 11 and electric motor 12. The electric motor is connected by suitable electrical conduits 23 to the control panel 21. The pump 11 is driven by the electric motor 12 through any suitable coupling means such as a belt 13. Both the pump 11 and motor 12 may be mounted on a suitable frame or base 34 which may also serve as the frame or base of the housing 30. The suction side of the pump 11 is in fluid communication with the fluid reservoir 10 through the conduit 16. To reduce noise and vibration, the conduit 16 may actually be a hose-type coupling attached at opposite ends to the pump inlet and a pipe stub 35 by suitable hose clamps 36 and 37. The inlet to the pipe stub 35 from reservoir 10 may be protected by a screen strainer 38.

Mounted in the upper part of housing 30 above reservoir 10 are the control valve 14 and noise suppressor 15. The control valve 14 is connected, preferably via a flexible conduit 39, to the discharge of pump 11. However, it will be noted that a passageway through the reservoir 10 is provided by a sleeve 40 which may be welded to the partition 33. Also connected to the control valve 14 is a return conduit 18 which exits, preferably through a spreader nozzle 41, into the reservoir 10. As previously described, the control valve 14 is also connected to conduits 19 and 20 and noise suppressor 15. The conduit 20 connects the power assembly P with the piston and cylinder unit U as previously described with reference to FIG. 1.

The control valve 14 can be of any suitable type commercially available to the industry. Since the control valve 14 is already available to the industry and since its specific design and construction form no part of the present invention, it will not be described in detail. For purposes of understanding the present invention, it is only necessary to understand that the control valve 14 is movable from a fully closed position to a fully open position, in which fluid enters, via conduit 39, and exits, via conduit 19. The control valve 14 is also movable to a partially open position in which fluid enters through conduit 39, part of it exiting through conduit 19 and the remaining part being bypassed through conduit 18 back into the reservoir 10. The control valve 14 also has a position in which fluid returning from the piston and cylinder unit U of FIG. 1 exits through conduit 18 for complete return to the reservoir 10. The various positions of the control valve 14 are determined by conventional control components located in the control panel 21 to which the control valve 14 is connected by suitable electrical conduits 22.

As earlier mentioned, the control valve 14 is one of the most frequently maintained components of the power assembly P. It must be properly maintained and occasionally its seals must be replaced. In the present invention, it is necessary only to remove the cover 31 for easy access to the control valve 14. Furthermore, upon disconnecting the control valve 14 for maintenance or removal, the fluid present therein or in the connecting conduits will drain into the reservoir 10 rather than on the floor as in previous power assemblies.

It will be noted that all of the working components of the power assembly can be easily reached for maintenance thereof. As already mentioned, the control valve 14 can be readily serviced from the standing position, whereas valves of the prior art are so mounted as to require sitting or squatting. In addition, the pump 11 and motor 12 can be easily serviced and reached through the access 32.

As a further safety feature of the present invention, the pump 11 and motor 12 are so mounted that the belt 13 is disposed at the side of the housing 30 opposite access 32. This prevents the repairman's body extremities or clothing from being caught as the power assembly is being worked on. This feature, as well as other construction features, makes the power assembly of the present invention one of the safest to maintain.

When not being worked on, the access 32 may be closed by a closure panel (not shown). Due to the easy access of all components from one side thereof, the power assembly may be mounted against a wall 42 and even tightly confined at its ends. Just as long as access is provided to the side opposite wall 42, maintenance can continue to be properly performed.

Not only is the power assembly of the present invention safe to maintain, but it is compact and easy to work on. One of the primary and most advantageous characteristics of the present invention is the location of the control valve directly above the fluid reservoir so that fluids do not get spilled on the floor.

Although only a single preferred embodiment of the invention has been described herein, many variations thereof may be made by those skilled in the art. Therefore, it is intended that the scope of the invention be limited only by the claims which follow.

I claim:

1. A power assembly for supplying hydraulic power to a hydraulic piston and cylinder unit for raising and lowering an elevator car, said power assembly comprising:

a housing for housing the components of said power assembly having upper and lower portions therein the upper portion of which is closed by a top cover;

a hydraulic fluid reservoir disposed in said upper housing portion;

a hydraulic pump mounted below said reservoir and having its intake connected to said reservoir;

a control valve mounted in said upper housing portion above said reservoir, below said top cover, and connected to the discharge side of said pump for controlling the flow of fluid from said pump to said piston and cylinder unit; and power means connected to said pump for supplying pumping power thereto.

2. A power assembly as set forth in claim 1 including noise suppression means within said upper housing portion, below said top cover, and connected between said control valve and said piston and cylinder unit through which fluid flows to and from said piston and cylinder unit for suppressing the noise produced thereby.

3. A power assembly as set forth in claim 1 including return conduit means providing fluid communication between said control valve and said reservoir on return flow of fluid from said piston and cylinder unit.

4. A power assembly as set forth in claim 3 including control means connected to said power means and said control valve for actuating said pump and controlling fluid flow to and from said piston and cylinder unit in response to signals from an operator of said elevator car.

5. A power assembly as set forth in claim 1 in which said control valve is connected to said discharge side of said pump by conduit means passing upwardly through said reservoir via sleeve means attached to the bottom of said reservoir and extending above the fluid level therein.

6. A power assembly as set forth in claim 1 in which said pump and power means are disposed in said lower portion of said housing and operatively connected by coupling means, said housing having access means on one side thereof providing access to said pump and power means, said coupling means being disposed on the side of said housing opposite the side in which said access means is disposed.

* * * * *